US007104770B2

(12) United States Patent
Bauer et al.

(10) Patent No.: US 7,104,770 B2
(45) Date of Patent: Sep. 12, 2006

(54) ECCENTRIC SCREW-TYPE PUMP WITH SPARE STATOR

(75) Inventors: Helmut Bauer, Dorfen (DE); Christoph Boehnisch, Munich (DE); Reinhard Denk, Muehldorf (DE); Matthias Gradl, Sesslach (DE); Michael Groth, Neuoetting (DE); Guido Gutmann, Hechendorf (DE); Guenther Hantschk, Taufkirchen (DE); Siegfried Jarzina, Waldkraiburg (DE); Franz Kneidl, Waldkraiburg (DE); Johann Kreidl, Waldkraiburg (DE); Robert Kurz, Aschheim (DE); Franz Lachenwitzer, Waldkraiburg (DE); Uwe Neumann, Wiesbaden (DE); Hansjuergen Linde, Gotha (DE); Thomas Ribbe, Muehldorf (DE); Michael Robby, Muehldorf (DE); Karl-Heinz Rosner, Freudenstadt (DE); Matthias Schaefer, Coburg (DE); Thomas Streubel, Kraiburg a. Inn (DE); Alfred Thumser, Aschau (DE)

(73) Assignee: NETZSCH-Mohnopumpen GmbH, Selb (DE)

( * ) Notice: Subject to any disclaimer, the term of this patent is extended or adjusted under 35 U.S.C. 154(b) by 219 days.

(21) Appl. No.: 10/665,554

(22) Filed: Sep. 22, 2003

(65) Prior Publication Data

US 2005/0100468 A1 May 12, 2005

(30) Foreign Application Priority Data

Sep. 20, 2002 (DE) ..... 102 43 674

(51) Int. Cl.
*F03C 2/00* (2006.01)
*F04C 18/00* (2006.01)

(52) U.S. Cl. ..... 418/48; 418/39

(58) Field of Classification Search ..... 418/48, 418/39

See application file for complete search history.

(56) References Cited

U.S. PATENT DOCUMENTS

| | | | | | |
|---|---|---|---|---|---|
| 2,957,427 | A | * | 10/1960 | O'Connor | 418/48 |
| 3,286,642 | A | * | 11/1966 | Lindberg | 418/48 |
| 4,580,955 | A | | 4/1986 | Karge | |
| 5,472,319 | A | * | 12/1995 | Rohlfing et al. | 418/48 |
| 5,807,087 | A | * | 9/1998 | Brandt et al. | 418/48 |

FOREIGN PATENT DOCUMENTS

| | | | |
|---|---|---|---|
| DE | 1985861 | U | 5/1968 |
| DE | 3345233 | A1 | 6/1985 |
| FR | 1 189 319 | A | 10/1959 |

* cited by examiner

*Primary Examiner*—Theresa Trieu
(74) *Attorney, Agent, or Firm*—Crowell & Moring LLP

(57) ABSTRACT

The present invention relates to the arrangement of a stator and a spare stator. In order to avoid a permanent correction in the length of the driving shaft, the spare stator is connected to the instantaneously operated stator or is configured in a single piece. Upon occurrence of a defined amount of wear, this stator combination is merely reversed through 180° relative to the longitudinal axis or an intermediate tube is inserted so that the spare stator arrives in the rotor region.

7 Claims, 2 Drawing Sheets

ECCENTRIC SCREW-TYPE PUMP WITH SPARE STATOR

BACKGROUND OF THE INVENTION

1. Field of the Invention

The present invention relates to an eccentric screw-type pump for pumping products of liquid to pasty consistency, comprising a drive unit that is connected via a driving shaft to a rotor, wherein a first stator and at least one further spare stator are provided.

2. Description of Related Art

An appropriate arrangement of the rotor and the stator or the spare stator, respectively, is disclosed in the German Patent DE 33 45 233 C2. There, an eccentric screw-type pump for pumping liquids from boreholes is used. The eccentric screw-type pumps are located in very substantial depths of up to a few hundreds of meters. As it were very expensive to withdraw the pump from this depth in the case of wear on the stator one or several spare stators are provided that are arranged at mutual distances. The distance between the stators fills the rising pipe. Whenever one or several of the spare stator(s) is employed the linkage is extended or reduced, respectively, in such an application.

The German Patent DE 19 85 861 U discloses a stator for an eccentric screw-type pump, which is composed of two parts. The joints of the two parts are sealed by means of a sealing ring. The rotor extends over both stator parts.

A corresponding arrangement would be too expensive in the conventional eccentric screw-type pumps operated above ground or on the surface and would enlarge the dimensions of the pumps.

SUMMARY OF THE INVENTION

The present invention is hence based on the problem of reducing the end-to-end dimensions and the volume of mechanical provisions of the pump in the case of application of spare stators.

In accordance with the present invention, this problem is solved by the features of claim 1.

Inventive improvements may be taken from the features defined in the dependent claims.

In a preferred embodiment, the stator is joined to the spare stator without a clearance or space. The two stator elements are expediently accommodated in a stator housing and made in a single piece.

The change to the application of the spare stator is expediently carried out by means of the provision that the two stators, which are in direct communication with each other, are turned through 180° relative to their longitudinal axis, which causes the spare stator to come into the range of action of the rotor.

For the compensation of the eccentricity created by the rotor, the flexible shaft requires a certain end-to-end dimension on account of its modulus of elasticity. Due to the fact that the flexible shaft extends beyond the pump casing and also beyond the stator part next to the drive system, the end-to-end dimension of the pump is reduced by the length of the stator or the spare stator, respectively.

In accordance with another inventive embodiment, the stator may be completed by an intermediate tube. This intermediate tube may be arranged both on the direct stator connector on the suction side downstream of the pump casing and on the delivery-side end of the stator ahead of the discharge tubulure. Due to the application of the delivery-side end of the stator, the length required for the flexible shaft is retained, independently of the respective stator part that is in operation.

For the rapid change of the stator and for the change of the intermediate tube it is advantageous that the pump flanges, the stator, the intermediate tube and the pump casing are connected to each other by means of quick-action clamping devices. In the following, the invention will be described by embodiments.

DETAILED DESCRIPTION OF THE INVENTION

Figure 1:
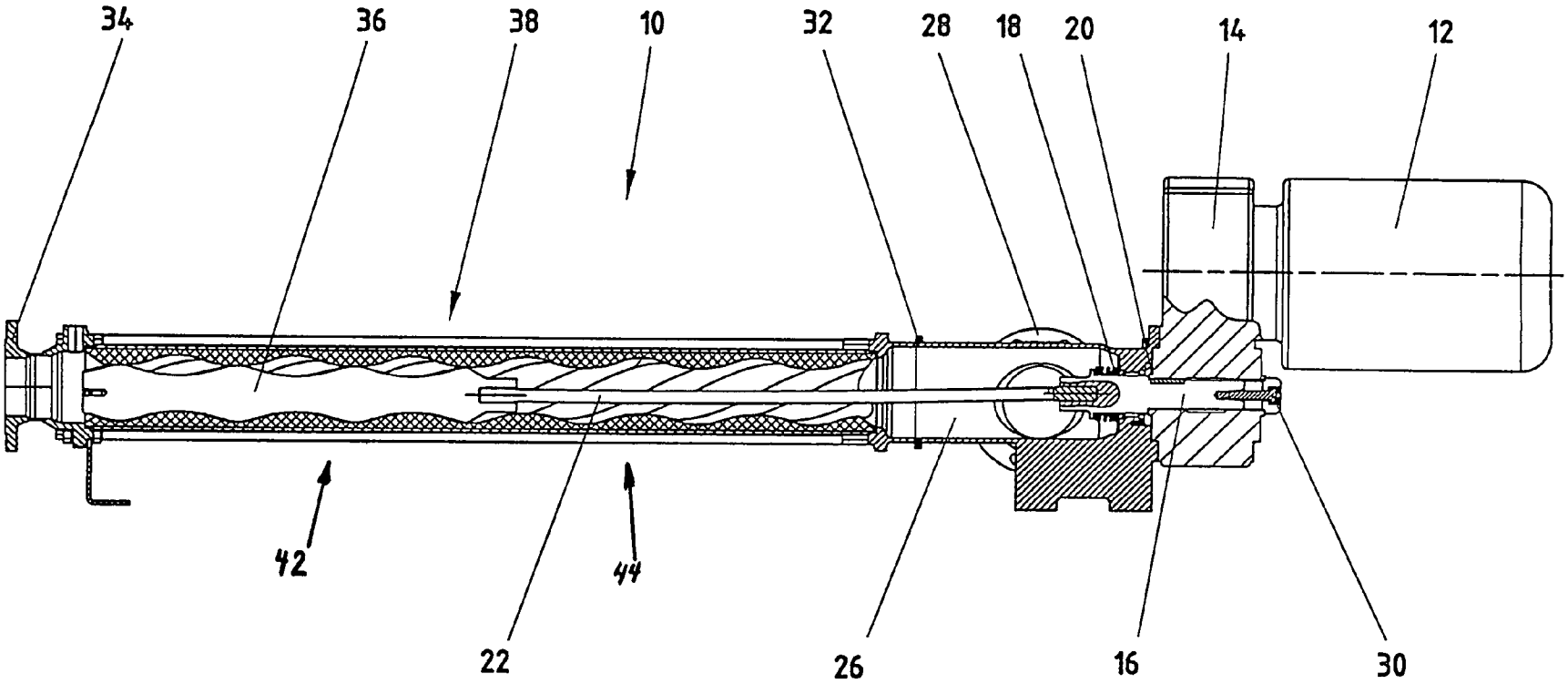
FIG. 1 is a longitudinal section through an eccentric screw-type pump.
Figure 2:
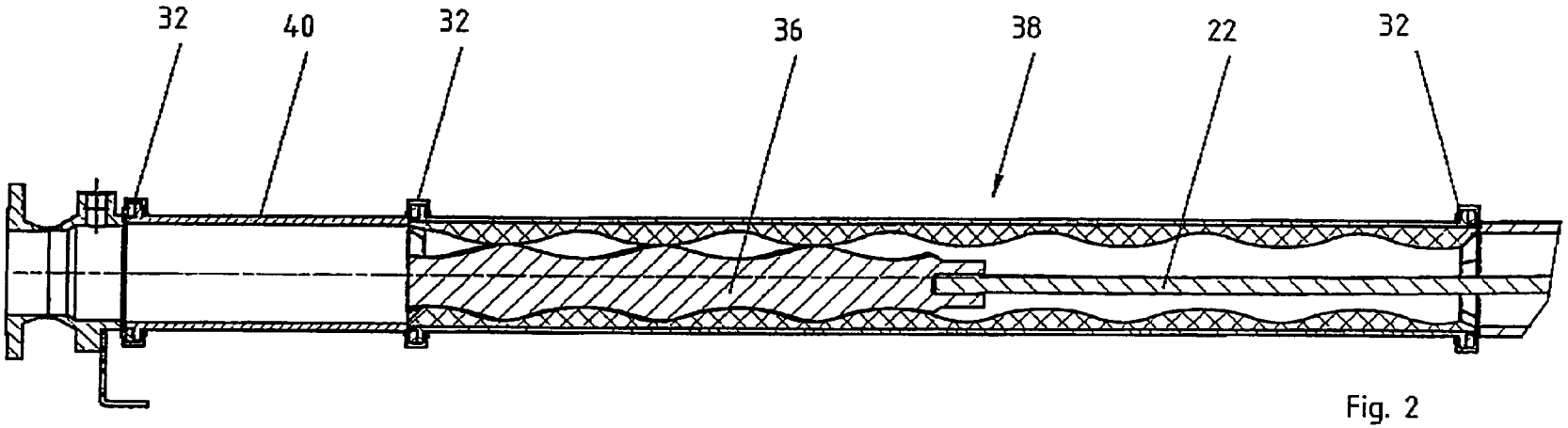
FIG. 2 shows a detail from a rotor/stator arrangement and the eccentric screw-type pump.
Figure 3:
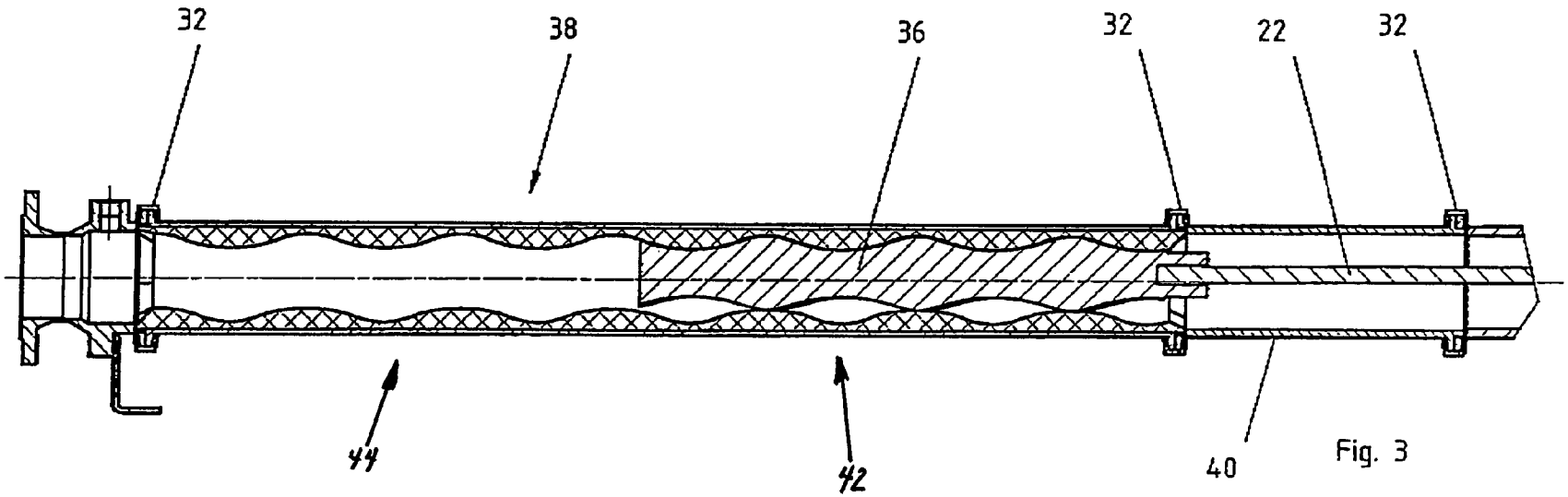
FIG. 3 illustrates a detail from a rotor/stator arrangement and the eccentric screw-type pump.

FIG. 1 illustrates an eccentric screw-type pump 10 of the Moineau type with a drive system 12 a gear unit 14 that is connected via a hollow shaft to a driving shaft 16 an operating region 42 and a spare region 44 comprised of at least one further spare stator. The driving shaft 16 is provided with a seal 18 that prevents the product from penetrating into the region of the bearing 20. The flexible shaft 22 and the driving shaft 16 are fixed to each other by a screw connection, a shrinking connection or an adhesive joint so as to prevent relative rotation. The pump casing 26 is provided with an inlet tubulure 28 through which the product is aspirated into the eccentric screw-type pump 10. When the screw 30 is released and the quick-action device 32 is unclamped, the stator 38 in its entirety can be withdrawn as a single unit from the pump casing 26 and the drive system 12, simultaneously with the terminating tubulure 34, the rotor 36, the flexible shaft 22 and the driving shaft 16, and can be replaced by a new spare unit. The stator 38 as such consists of a deformable inner layer with an at least double-thread spiral for accommodation of the rotor 36 and a rigid stator envelope. FIG. 2 and FIG. 3 illustrate the arrangements of an intermediate tube 40.

According to FIG. 2, the intermediate tube 40 is located between the delivery-side end of the stator 38 and the terminating tubulure 34 until the partial region of the stator 38 that is instantaneously involved in the pumping operation has suffered a defined amount of wear. When this amount of wear is detected by the reduced pumping pressure or by similar wear characteristics the pumping operation is stopped, the quick-action clamping device 32 is released, the intermediate tube 40 is directly connected to the pump casing 26 and the quick-action clamping device 30 is closed. Due to the relocation of the intermediate casing, the position of the rotor 36 is not shifted, however the position of the stator 38 is changed and hence the zone in which the rotor cooperates with the stator 38 as pump is displaced by half of the entire stator length.

LIST OF REFERENCE NUMERALS

10 eccentric screw-type pump
12 drive system
14 gear unit
16 driving shaft
18 seal

20 bearing
22 shaft
24 blind hole
26 pump casing
28 inlet tubulure
30 screw
32 quick-action clamping device
34 terminating tubulure
36 rotor
38 stator
40 intermediate tube
42 operation region
44 spare region

The invention claimed is:

1. Eccentric screw-type pump, comprising a drive system that is operatively connected, via a driving shaft, to a rotor, with a first stator and at least one further spare stator, wherein said first stator and said at least one further spare stator are joined to each other, without a space therebetween, such that said first stator presents an operating region and a spare region, with said first stator being reversible or displaceable for switching said operating and spare regions.

2. Eccentric screw-type pump according to claim 1, wherein said first stator and at least one further spare stator comprise a stator in a stator envelope.

3. Eccentric screw-type pump according to claim 2, wherein a change of engagement of said rotor from a used part of the stator to the stator part reserved as a substitute is carried out by moving the stator through 180° relative to a longitudinal axis thereof.

4. Eccentric screw-type pump according to claim 1, wherein said rotor is connected, via a flexible shaft, to said drive system, which flexible shaft extends permanently beyond a free stator half adjacent said drive system.

5. Eccentric screw-type pump comprising a drive system that is operatively connected, via a driving shaft, to a rotor, with a first stator and at least one further spare stator, wherein said first stator and said at least one further spare stator are joined to each other, without a space therebetween, such that said first stator presents an operating region and a spare region, with said first stator being reversible or displaceable for switching said operating and spare regions and, wherein said stator comprises an intermediate tube arrangeable on a suction-side end or a delivery-side end of said stator.

6. Eccentric screw-type pump according to the claim 5, wherein said flexible shaft is sized to extend to said stator through said intermediate tube arranged at the delivery-side end of said stator.

7. Eccentric screw-type pump comprising a drive system that is operatively connected, via a driving shaft, to a rotor, with a first stator and at least one further spare stator, wherein said first stator and said at least one further spare stator are joined to each other, without a space therebetween, such that said first stator presents an operating region and a spare region, with said first stator being reversible or displaceable for switching said operating and spare regions, and wherein said stator is connectable to a pump casing and terminating tubulure via a quick-action clamping device.

* * * * *